United States Patent [19]

LePore

[11] Patent Number: 4,458,788

[45] Date of Patent: Jul. 10, 1984

[54] ANALYZER APPARATUS

[75] Inventor: Paul E. LePore, Taunton, Mass.

[73] Assignee: Delta Elevator Equipment Corporation, Allston, Mass.

[21] Appl. No.: 381,169

[22] Filed: May 24, 1982

[51] Int. Cl.[3] ..... B66B 3/00

[52] U.S. Cl. ..... 187/29 R

[58] Field of Search ..... 187/29

[56] References Cited

U.S. PATENT DOCUMENTS

| | | | |
|---|---|---|---|
| 2,619,592 | 11/1952 | Paulson et al. | 250/27 |
| 3,593,825 | 7/1971 | Gieseler | 187/29 |
| 3,781,901 | 12/1973 | Morrison | 346/1 |
| 3,973,648 | 8/1976 | Hummert et al. | 187/29 |
| 4,106,593 | 8/1978 | Otto et al. | 187/29 |
| 4,305,479 | 12/1981 | Bittar et al. | 187/29 |
| 4,330,838 | 5/1982 | Yoneda et al. | 187/29 X |
| 4,370,717 | 1/1983 | Hummert et al. | 187/29 X |
| 4,397,377 | 8/1983 | Husson et al. | 187/29 |
| 4,401,192 | 8/1983 | Trosky et al. | 187/29 |

*Primary Examiner*—G. Z. Rubinson
*Assistant Examiner*—W. E. Duncanson, Jr.

[57] ABSTRACT

Analyzer apparatus for evaluating the performance of an elevator type transportation system that has a plurality of transport vehicles that serve a plurality of common stations includes a plurality of interface circuits each for connection to a system component to be monitored such as an elevator hall call button or a car relay, and each providing an output signal indicative of the current status of its monitored system component. Associated with each interface circuit is one or more event accumulator devices, and logic interconnects each interface circuit and its corresponding event accumulator device or devices. The analyzer also includes a signal generator for repetitively generating signals at periodic time intervals, and circuitry for applying each time interval signal to the logic for causing an accumulator device to accumulate event duration counts as a function of the monitored component current status signals from its interface circuit.

14 Claims, 9 Drawing Figures

DELTA 5048 - ELEVATOR TRAFFIC STUDY PAGE 4

BUILDING NAME & ADDRESS
ABBOTT OFFICE BUILDING
42 STATE STREET
BOSTON MA. 10304

SYSTEM DESCRIPTION
4 PROGRAM AUTOTRONIC

STUDY COMMISSIONED BY
ASSOCIATED MANAGEMENT INC.
172 NO. OF CARS - 4
174 NO. OF STOPS - 14
SCAN DATE - 03/24/82
SCAN TIME - 06-30 NO. HRS - 24
PEN NO. & FUNCTION - 3 LB UP 176
REPORT DATE - 03/25/82

| 180 TIME SLOT | | 182 # CALLS | 184 TOT C/S | 186 -- NO OF CALLS ANSWERED IN -- 0-30S | 188 31-60S | 190 61-90S | 192 90+S | 194 AVG W/T |
|---|---|---|---|---|---|---|---|---|
| 6-30 | 7-30 | 14 | 31 | 14 | 0 | 0 | 0 | 2.21 |
| 7-30 | 8-30 | 34 | 137 | 34 | 0 | 0 | 0 | 4.03 |
| 8-30 | 9-30 | 65 | 426 | 62 | 3 | 0 | 0 | 6.55 |
| 9-30 | 10-30 | 42 | 553 | 36 | 4 | 2 | 0 | 13.17 |
| 10-30 | 11-30 | 34 | 454 | 28 | 6 | 0 | 0 | 13.35 |
| 11-30 | 12-30 | 31 | 578 | 25 | 5 | 1 | 0 | 18.65 |
| 12-30 | 13-30 | 66 | 722 | 62 | 2 | 2 | 0 | 10.94 |
| 13-30 | 14-30 | 46 | 653 | 39 | 5 | 2 | 0 | 14.20 |
| 14-30 | 15-30 | 32 | 329 | 28 | 4 | 0 | 0 | 10.28 |
| 15-30 | 16-30 | 36 | 334 | 34 | 2 | 0 | 0 | 9.28 |
| 16-30 | 17-30 | 20 | 193 | 19 | 1 | 0 | 0 | 9.65 |
| 17-30 | 18-30 | 9 | 65 | 9 | 0 | 0 | 0 | 7.22 |
| 18-30 | 19-30 | 3 | 10 | 3 | 0 | 0 | 0 | 3.33 |
| 19-30 | 20-30 | 10 | 24 | 10 | 0 | 0 | 0 | 2.40 |
| 20-30 | 21-30 | 0 | 0 | 0 | 0 | 0 | 0 | 0.00 |
| 21-30 | 22-30 | 0 | 0 | 0 | 0 | 0 | 0 | 0.00 |
| 22-30 | 23-30 | 0 | 0 | 0 | 0 | 0 | 0 | 0.00 |
| 23-30 | 0-30 | 1 | 2 | 1 | 0 | 0 | 0 | 2.00 |
| 0-30 | 1-30 | 0 | 0 | 0 | 0 | 0 | 0 | 0.00 |
| 1-30 | 2-30 | 0 | 0 | 0 | 0 | 0 | 0 | 0.00 |
| 2-30 | 3-30 | 0 | 0 | 0 | 0 | 0 | 0 | 0.00 |
| 3-30 | 4-30 | 0 | 0 | 0 | 0 | 0 | 0 | 0.00 |
| 4-30 | 5-30 | 0 | 0 | 0 | 0 | 0 | 0 | 0.00 |
| 5-30 | 6-30 | 0 | 0 | 0 | 0 | 0 | 0 | 0.00 |
| TOTALS | | 443 | 4511 | 404 | 32 | 7 | 0 | 10.18 |

FIG 5

DELTA 5048 - ELEVATOR TRAFFIC STUDY PAGE 27

BUILDING NAME & ADDRESS
ABBOTT OFFICE BUILDING
42 STATE STREET
BOSTON MA. 10304

SYSTEM DESCRIPTION
4 PROGRAM AUTOTRONIC

STUDY COMMISSIONED BY
ASSOCIATED MANAGEMENT INC.
NO. OF CARS - 4
NO. OF STOPS - 14
SCAN DATE - 03/24/82
SCAN TIME - 06-30 NO. HRS - 24
PEN NO. & FUNCTION - 26 12 DN
REPORT DATE - 03/25/82

178

| 180 | | 182 | 184 | 186 | 188 | 190 | 192 | 194 |
|---|---|---|---|---|---|---|---|---|
| | | | | -- NO OF CALLS ANSWERED IN -- | | | | |
| TIME SLOT | | # CALLS | TOT C/S | 0-30S | 31-60S | 61-90S | 90+S | AVG W/T |
| 6-30 | 7-30 | 2 | 35 | 2 | 0 | 0 | 0 | 17.50 |
| 7-30 | 8-30 | 1 | 18 | 1 | 0 | 0 | 0 | 18.00 |
| 8-30 | 9-30 | 1 | 5 | 1 | 0 | 0 | 0 | 5.00 |
| 9-30 | 10-30 | 10 | 354 | 5 | 3 | 2 | 0 | 35.40 |
| 10-30 | 11-30 | 4 | 112 | 3 | 0 | 1 | 0 | 28.00 |
| 11-30 | 12-30 | 14 | 536 | 6 | 5 | 2 | 1 | 38.29 |
| 12-30 | 13-30 | 12 | 336 | 7 | 4 | 1 | 0 | 28.00 |
| 13-30 | 14-30 | 11 | 376 | 4 | 5 | 2 | 0 | 34.18 |
| 14-30 | 15-30 | 8 | 171 | 7 | 1 | 0 | 0 | 21.38 |
| 15-30 | 16-30 | 5 | 148 | 3 | 2 | 0 | 0 | 29.60 |
| 16-30 | 17-30 | 14 | 348 | 9 | 5 | 0 | 0 | 24.86 |
| 17-30 | 18-30 | 8 | 153 | 7 | 1 | 0 | 0 | 19.13 |
| 18-30 | 19-30 | 5 | 127 | 4 | 1 | 0 | 0 | 25.40 |
| 19-30 | 20-30 | 2 | 44 | 2 | 0 | 0 | 0 | 22.00 |
| 20-30 | 21-30 | 0 | 0 | 0 | 0 | 0 | 0 | 0.00 |
| 21-30 | 22-30 | 0 | 0 | 0 | 0 | 0 | 0 | 0.00 |
| 22-30 | 23-30 | 0 | 0 | 0 | 0 | 0 | 0 | 0.00 |
| 23-30 | 0-30 | 0 | 0 | 0 | 0 | 0 | 0 | 0.00 |
| 0-30 | 1-30 | 0 | 0 | 0 | 0 | 0 | 0 | 0.00 |
| 1-30 | 2-30 | 0 | 0 | 0 | 0 | 0 | 0 | 0.00 |
| 2-30 | 3-30 | 0 | 0 | 0 | 0 | 0 | 0 | 0.00 |
| 3-30 | 4-30 | 0 | 0 | 0 | 0 | 0 | 0 | 0.00 |
| 4-30 | 5-30 | 0 | 0 | 0 | 0 | 0 | 0 | 0.00 |
| 5-30 | 6-30 | 0 | 0 | 0 | 0 | 0 | 0 | 0.00 |
| TOTALS | | 97 | 2763 | 61 | 27 | 8 | 1 | 28.48 |

FIG 6

DELTA 5048 - ELEVATOR TRAFFIC STUDY PAGE 28

BUILDING NAME & ADDRESS
ABBOTT OFFICE BUILDING
42 STATE STREET
BOSTON MA. 10304

SYSTEM DESCRIPTION
4 PROGRAM AUTOTRONIC

STUDY COMMISSIONED BY
ASSOCIATED MANAGEMENT INC.
NO. OF CARS - 4
NO. OF STOPS - 14
SCAN DATE - 03/24/82
SCAN TIME - 06-30 NO. HRS - 24
PEN NO. & FUNCTION - COMP. UP
REPORT DATE - 03/25/82

| 180 | | 182 | 184 | 186 | 188 | 190 | 192 | 194 |
|---|---|---|---|---|---|---|---|---|
| | | | | -- NO OF CALLS ANSWERED IN -- | | | | |
| TIME SLOT | | # CALLS | TOT C/S | 0-30S | 31-60S | 61-90S | 90+S | AVG W/T |
| 6-30 | 7-30 | 18 | 87 | 17 | 1 | 0 | 0 | 4.83 |
| 7-30 | 8-30 | 64 | 578 | 60 | 2 | 2 | 0 | 9.03 |
| 8-30 | 9-30 | 90 | 1209 | 78 | 8 | 3 | 1 | 13.43 |
| 9-30 | 10-30 | 69 | 1439 | 50 | 14 | 4 | 1 | 20.86 |
| 10-30 | 11-30 | 67 | 1450 | 47 | 17 | 2 | 1 | 21.64 |
| 11-30 | 12-30 | 68 | 1899 | 48 | 11 | 6 | 3 | 27.93 |
| 12-30 | 13-30 | 98 | 1704 | 82 | 9 | 7 | 0 | 17.39 |
| 13-30 | 14-30 | 82 | 1740 | 60 | 16 | 5 | 1 | 21.22 |
| 14-30 | 15-30 | 51 | 857 | 40 | 10 | 1 | 0 | 16.80 |
| 15-30 | 16-30 | 69 | 1138 | 56 | 12 | 1 | 0 | 16.49 |
| 16-30 | 17-30 | 41 | 801 | 30 | 9 | 2 | 0 | 19.54 |
| 17-30 | 18-30 | 40 | 592 | 36 | 3 | 1 | 0 | 14.80 |
| 18-30 | 19-30 | 21 | 214 | 21 | 0 | 0 | 0 | 10.19 |
| 19-30 | 20-30 | 20 | 101 | 20 | 0 | 0 | 0 | 5.05 |
| 20-30 | 21-30 | 3 | 21 | 3 | 0 | 0 | 0 | 7.00 |
| 21-30 | 22-30 | 0 | 0 | 0 | 0 | 0 | 0 | 0.00 |
| 22-30 | 23-30 | 0 | 0 | 0 | 0 | 0 | 0 | 0.00 |
| 23-30 | 0-30 | 1 | 2 | 1 | 0 | 0 | 0 | 2.00 |
| 0-30 | 1-30 | 0 | 0 | 0 | 0 | 0 | 0 | 0.00 |
| 1-30 | 2-30 | 0 | 0 | 0 | 0 | 0 | 0 | 0.00 |
| 2-30 | 3-30 | 0 | 0 | 0 | 0 | 0 | 0 | 0.00 |
| 3-30 | 4-30 | 0 | 0 | 0 | 0 | 0 | 0 | 0.00 |
| 4-30 | 5-30 | 0 | 0 | 0 | 0 | 0 | 0 | 0.00 |
| 5-30 | 6-30 | 0 | 0 | 0 | 0 | 0 | 0 | 0.00 |
| TOTALS | | 802 | 13832 | 649 | 112 | 34 | 7 | 17.25 |

FIG 7

DELTA 5048 - ELEVATOR TRAFFIC STUDY PAGE 30

BUILDING NAME & ADDRESS
ABBOTT OFFICE BUILDING
42 STATE STREET
BOSTON MA. 10304

SYSTEM DESCRIPTION
4 PROGRAM AUTOTRONIC

STUDY COMMISSIONED BY
ASSOCIATED MANAGEMENT INC.
NO. OF CARS - 4
NO. OF STOPS - 14
SCAN DATE - 03/24/82
SCAN TIME - 06-30 NO. HRS - 24
PEN NO. & FUNCTION - COMP. ALL
REPORT DATE - 03/25/82

| 180 | | 182 | 184 | 186 | 188 | 190 | 192 | 194 |
|---|---|---|---|---|---|---|---|---|
| | | | | -- NO OF CALLS ANSWERED IN -- | | | | |
| TIME SLOT | | # CALLS | TOT C/S | 0-30S | 31-60S | 61-90S | 90+S | AVG W/T |
| 6-30 | 7-30 | 51 | 352 | 49 | 2 | 0 | 0 | 6.90 |
| 7-30 | 8-30 | 105 | 1148 | 93 | 9 | 3 | 0 | 10.93 |
| 8-30 | 9-30 | 127 | 2298 | 100 | 19 | 7 | 1 | 18.09 |
| 9-30 | 10-30 | 173 | 5383 | 102 | 39 | 26 | 6 | 31.12 |
| 10-30 | 11-30 | 166 | 4398 | 103 | 51 | 11 | 1 | 26.49 |
| 11-30 | 12-30 | 231 | 7724 | 134 | 55 | 29 | 13 | 33.44 |
| 12-30 | 13-30 | 222 | 4994 | 161 | 45 | 15 | 1 | 22.50 |
| 13-30 | 14-30 | 205 | 5887 | 119 | 59 | 25 | 2 | 28.72 |
| 14-30 | 15-30 | 140 | 3206 | 94 | 42 | 3 | 1 | 22.90 |
| 15-30 | 16-30 | 178 | 3893 | 125 | 46 | 7 | 0 | 21.87 |
| 16-30 | 17-30 | 196 | 4495 | 136 | 47 | 13 | 0 | 22.93 |
| 17-30 | 18-30 | 108 | 1781 | 92 | 15 | 1 | 0 | 16.49 |
| 18-30 | 19-30 | 56 | 749 | 53 | 3 | 0 | 0 | 13.38 |
| 19-30 | 20-30 | 61 | 1042 | 55 | 2 | 2 | 2 | 17.08 |
| 20-30 | 21-30 | 6 | 52 | 6 | 0 | 0 | 0 | 8.67 |
| 21-30 | 22-30 | 0 | 0 | 0 | 0 | 0 | 0 | 0.00 |
| 22-30 | 23-30 | 0 | 0 | 0 | 0 | 0 | 0 | 0.00 |
| 23-30 | 0-30 | 2 | 13 | 2 | 0 | 0 | 0 | 6.50 |
| 0-30 | 1-30 | 0 | 0 | 0 | 0 | 0 | 0 | 0.00 |
| 1-30 | 2-30 | 0 | 0 | 0 | 0 | 0 | 0 | 0.00 |
| 2-30 | 3-30 | 0 | 0 | 0 | 0 | 0 | 0 | 0.00 |
| 3-30 | 4-30 | 0 | 0 | 0 | 0 | 0 | 0 | 0.00 |
| 4-30 | 5-30 | 0 | 0 | 0 | 0 | 0 | 0 | 0.00 |
| 5-30 | 6-30 | 3 | 7 | 3 | 0 | 0 | 0 | 2.33 |
| TOTALS | | 2030 | 47422 | 1427 | 434 | 142 | 27 | 23.36 |

FIG 8

DELTA 5048 - ELEVATOR TRAFFIC STUDY PAGE 31

BUILDING NAME & ADDRESS
ABBOTT OFFICE BUILDING
42 STATE STREET
BOSTON MA. 10304

SYSTEM DESCRIPTION
4 PROGRAM AUTOTRONIC

STUDY COMMISSIONED BY
ASSOCIATED MANAGEMENT INC.
NO. OF CARS - 4
NO. OF STOPS - 14
SCAN DATE - 03/24/82
SCAN TIME - 06-30 NO. HRS - 24
PEN NO. & FUNCTION - CIS
REPORT DATE - 03/25/82

| 180 TIME | SLOT | 196 AV. CARS | 198 TOT C/S | 200 CIS |
|---|---|---|---|---|
| 6-30 | 7-30 | 4 | 10800 | 3.00 |
| 7-30 | 8-30 | 4 | 10805 | 3.00 |
| 8-30 | 9-30 | 4 | 10800 | 3.00 |
| 9-30 | 10-30 | 4 | 10800 | 3.00 |
| 10-30 | 11-30 | 4 | 10800 | 3.00 |
| 11-30 | 12-30 | 4 | 10385 | 2.88 |
| 12-30 | 13-30 | 4 | 10800 | 3.00 |
| 13-30 | 14-30 | 4 | 10800 | 3.00 |
| 14-30 | 15-30 | 4 | 10800 | 3.00 |
| 15-30 | 16-30 | 4 | 10800 | 3.00 |
| 16-30 | 17-30 | 4 | 10800 | 3.00 |
| 17-30 | 18-30 | 4 | 10800 | 3.00 |
| 18-30 | 19-30 | 4 | 10806 | 3.00 |
| 19-30 | 20-30 | 4 | 10800 | 3.00 |
| 20-30 | 21-30 | 4 | 10800 | 3.00 |
| 21-30 | 22-30 | 4 | 10800 | 3.00 |
| 22-30 | 23-30 | 4 | 10800 | 3.00 |
| 23-30 | 0-30 | 4 | 10800 | 3.00 |
| 0-30 | 1-30 | 4 | 10800 | 3.00 |
| 1-30 | 2-30 | 4 | 10800 | 3.00 |
| 2-30 | 3-30 | 4 | 10800 | 3.00 |
| 3-30 | 4-30 | 4 | 10800 | 3.00 |
| 4-30 | 5-30 | 4 | 10800 | 3.00 |
| 5-30 | 6-30 | 4 | 10800 | 3.00 |

FIG 9

ANALYZER APPARATUS

This invention relates to elevator systems and the like, and more particularly to analyzer apparatus for evaluating performance characteristics of such systems.

Conventionally, a "strip chart recorder" is used to analyze the performance of an elevator system, as indicated by the response of the elevator cars to landing calls for example, which recorder provides a graphical record of the lengths of time that the elevator system requires to respond to landing calls or other monitored conditions. In a typical elevator system, at each landing or hall, there are two call buttons or similar devices, actuation of one button signaling a call or request for a "down" elevator car and the other button signaling a call or request for an "up" elevator car. The strip chart recorder is electrically connected to the landing call signals, and produces a graphical record of the time duration that a call signal from each call button remains active without an elevator car stopping at that floor in response to the call. Although this strip chart recorder technique does provide meaningful and useful information regarding elevator system performance, the analysis of the chart record is a laborious and time consuming process which is difficult to perform accurately.

In accordance with the invention, there is provided analyzer apparatus for evaluating the performance of an elevator type transportation system that has a plurality of transport vehicles that serve a plurality of common stations or similar system in which a multitude of system components interact with one another. The analyzer apparatus includes a plurality of interface circuits each for connection to a system component to be monitored such as an elevator hall call button or a car relay, and each providing an output signal indicative of the current status of its monitored system component. Associated with each interface circuit is one or more event accumulator devices, and logic interconnects each interface circuit and its corresponding event accumulator device or devices. The analyzer also includes a signal generator for repetitively generating signals at periodic time intervals, and circuitry for applying each time interval signal to the logic for causing an accumulator device to accumulate event duration counts as a function of the monitored component current status signals from its interface circuit.

In a particular embodiment, each monitoring channel of the analyzer includes a two stage status register that provides an indication of the status of the system component monitored by that channel and the logic includes a first accumulator device for recording a system event such as the number of calls for elevators at each of a plurality of floors and a second accumulator device for recording another system event such as the accumulated time that calls for each floor remain unanswered. The analyzer also includes means to vary the periodic time intervals at which the signal generator repetitively generates signals for application to the logic to a variety of analyzer timing sequences, so that the analyzer is capable of monitoring system transient conditions of short duration, for example. In this particular embodiment, a hard copy print out provides summaries of elevator activity over a twenty-four hour monitoring interval with a separate summary for each hall call button as well as cars in service information in a form that is easy to read and to analyze.

The interface circuit of each channel in that embodiment includes an input circuit for receiving a status signal from its monitored system component with a voltage divider network arranged to apply a fraction of the voltage of the status signal to threshold circuitry, the analyzer being compatible with a wide range of input voltages. The threshold circuitry generates a trigger signal when the status signal from its input circuit exceeds its threshold, which can be varied. Isolator circuitry coupled between the threshold circuitry and the output of the interface circuit includes a photo isolator device. An asymmetrically conductive device is connected in circuit such that the interface circuit processes both AC and DC status signals.

Other features and advantages of the invention will be seen as the following description of particular embodiments progresses, in conjunction with the drawings, in which:

FIGS. 5–9 are printouts of portions of an elevator traffic study made with apparatus in accordance with the invention.

DESCRIPTION OF PARTICULAR EMBODIMENTS

Figure 1:
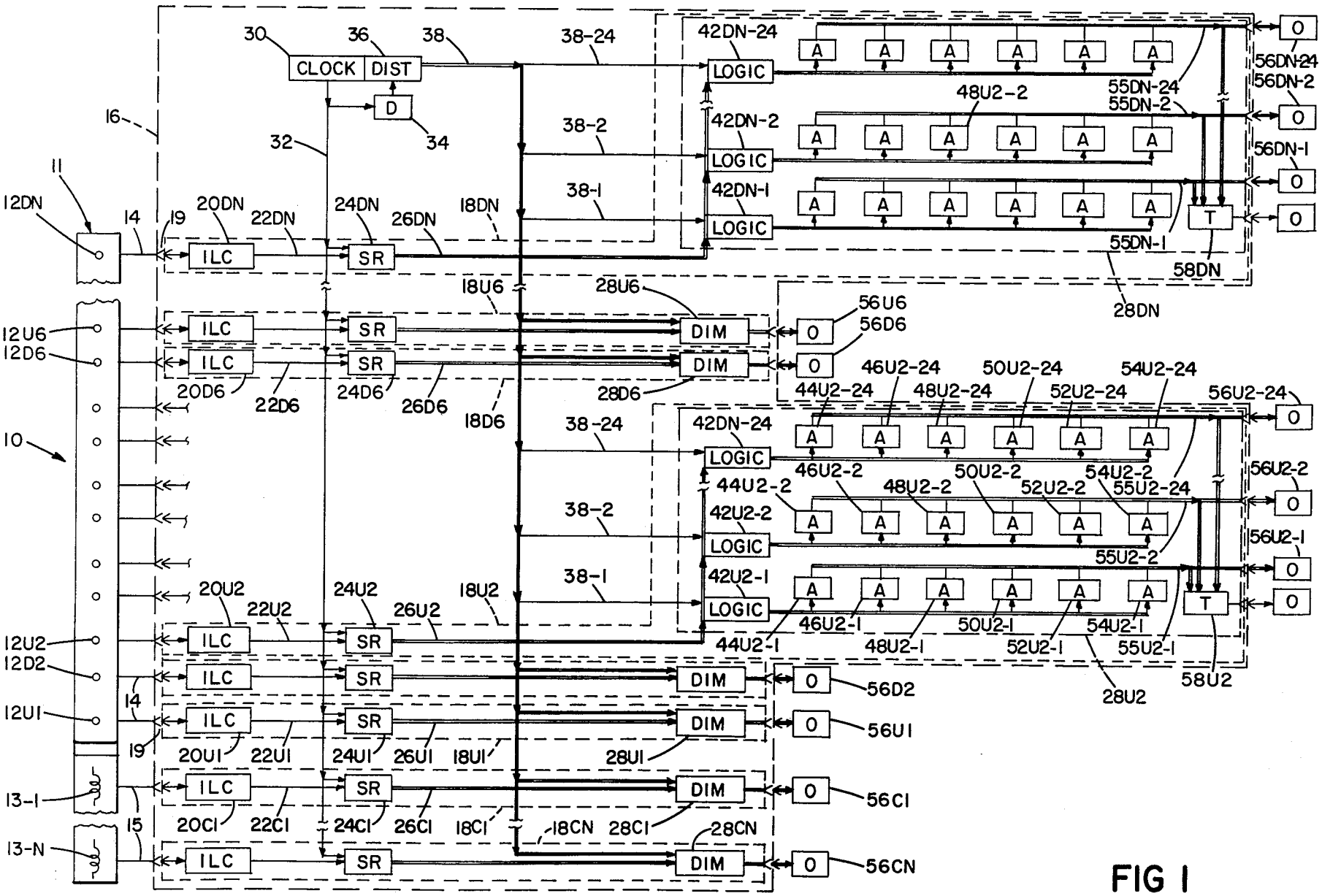
FIG. 1 is block diagram of analyzer apparatus in accordance with the invention.

Diagrammatically indicated in FIG. 1 is an elevator system 10 that includes a plurality of elevator cars mounted for movement through elevator shafts for serving the several floors of a building, and an elevator control system 11. Associated with the elevator system are a myriad of signaling devices that indicate, for example, car position, movement of cars, car calls, hall calls, status signals and landing detectors. Indicated diagrammatically in FIG. 1 are hall buttons 12 which are mounted in the landings adjacent the elevator shafts served by the elevator system and which register hall calls, up button 12U1 being located at the bottom landing, down button 12DN being located at the top landing, and up buttons 12U and down buttons 12D being located at the second and other intermediate landings. Actuation of a button 12 at a particular landing registers call for an elevator car by an intending passenger, the actuated button generating an output signal (for example a touch button signal might be 55 volts with respect to its 135 volt DC above ground reference) on line 14 indicating the "hall call". When an elevator car stops at the landing, the call is automatically cancelled incident to the car stopping operation. Also indicated diagrammatically in FIG. 1 are car relays 13, each of which is energized when its car is in service and provides, for example, the 120 volt relay voltage on line 15. Analyzer system 16 includes a plurality of monitoring channels 18, each of which is connected via a connector 19 to a corresponding elevator system signaling device (e.g., a hall button 12 or a car relay 13) that is to be monitored. In a particular embodiment, the analyzer system has sixty-four channels 18. Each channel 18 includes an input level converter (ILC) circuit 20 that supplies outputs on lines 22 to status register (SR) device 24, and that device, in turn, provides outputs on lines 26 to data interpretation module (DIM) 28. Clock circuit 30 provides a primary output on line 32 that is routed to status registers 24, and through delay circuit 34 and distributor module 36 a delayed output that is routed over the twenty-four lines of cable 38.

Each input level converter 20 inverts the transducer signal voltage at its connector 19 to a voltage level compatible with its status register 24, and is designed for calibration at 35 volts for operation over a range of 35–300 volts AC or DC. With an external translator module for connection to system output lines 14, 15 as appropriate, analyzer 16 accepts signals as low as 3.5 volts DC. The input signals at connector 19 of each channel 18 are electrically isolated from the rest of the analyzer 16 and do not rely a common return, so that the analyzer accommodates simultaneous monitoring of different electrical systems.

Each status register 24 is a two stage register which responds to outputs from its input level converter circuit 20 and provides outputs to its data interpreter module 28. Each status register 24 compares the current status of the monitored signal at connector 19 with its value at the immediately prior clock interval. Timing for the status registers 24 is provided by a one hertz clock pulse on line 32 from clock module 30. In response to each clock pulse on line 32, a current status signal from each input level converter 20 is clocked into the current status stage of its status register 24, and the status signal stored in that stage is clocked into the previous status stage of the status register. Each channel 18 thus updates status information of its monitored component every second.

Each data interpreter module 28 includes twenty-four logic devices 42 that respond to signals on cables 26 and 38, the outputs of each logic device 42 being applied to a series of accumulator devices 44–54 associated with that logic device 42. Coupled to each group of accumulator devices 44–54 via cable 55 is an appropriate output device 56, a data transducer, a display, or a hard copy printer, for example, and one or more totalizer modules 58 are coupled to the output buses 55 of each DIM 28 for accumulating pertinent twenty-four hour totals for each analyzer channel 18.

Figure 2:
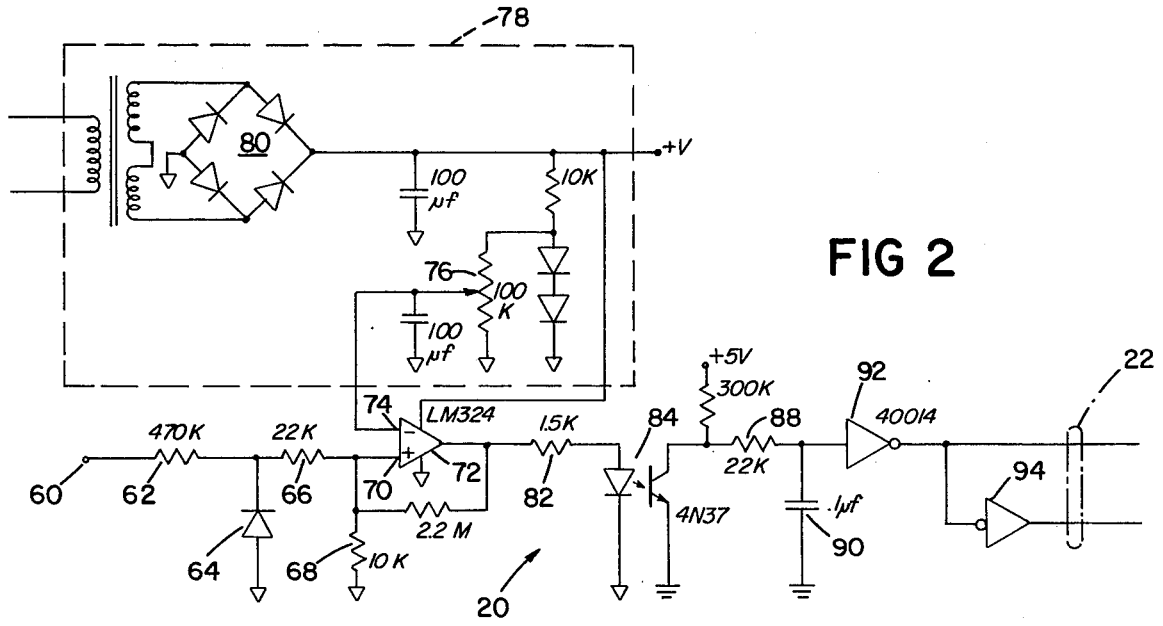
FIG. 2 is a schematic diagram of an input level converter circuit of the analyzer shown in FIG. 1.

A schematic diagram of an input level converter circuit 20 is shown in FIG. 2. That circuit has an input terminal 60 to which the voltage from the monitored call button 12 or other system device is applied via connector 19. This circuit is adapted to receive both AC and DC signals of voltages up to 300 volts for application to input resistor 62. Clipping diode 64 blocks the negative half cycles of AC signals. An input resistor of higher dissipation would permit processing of still higher voltages. The voltage divider network of resistors 62, 66 and 68 applies the input signal to input 70 of Schmitt trigger circuit 72, an adjustable reference voltage being applied to reference terminal 74 from potentiometer 76 of the voltage supply circuit 78 that includes full wave rectifier circuit 80. When the input signal at input terminal 70 exceeds the reference threshold, amplifier 72 generates an output through resistor 82 to photo isolator 84, and the output of isolator 84 is applied through a filter circuit of resistor 88 and capacitor 90 to inverters 92 and 94 for generation of status signals on lines 22.

Figure 3:
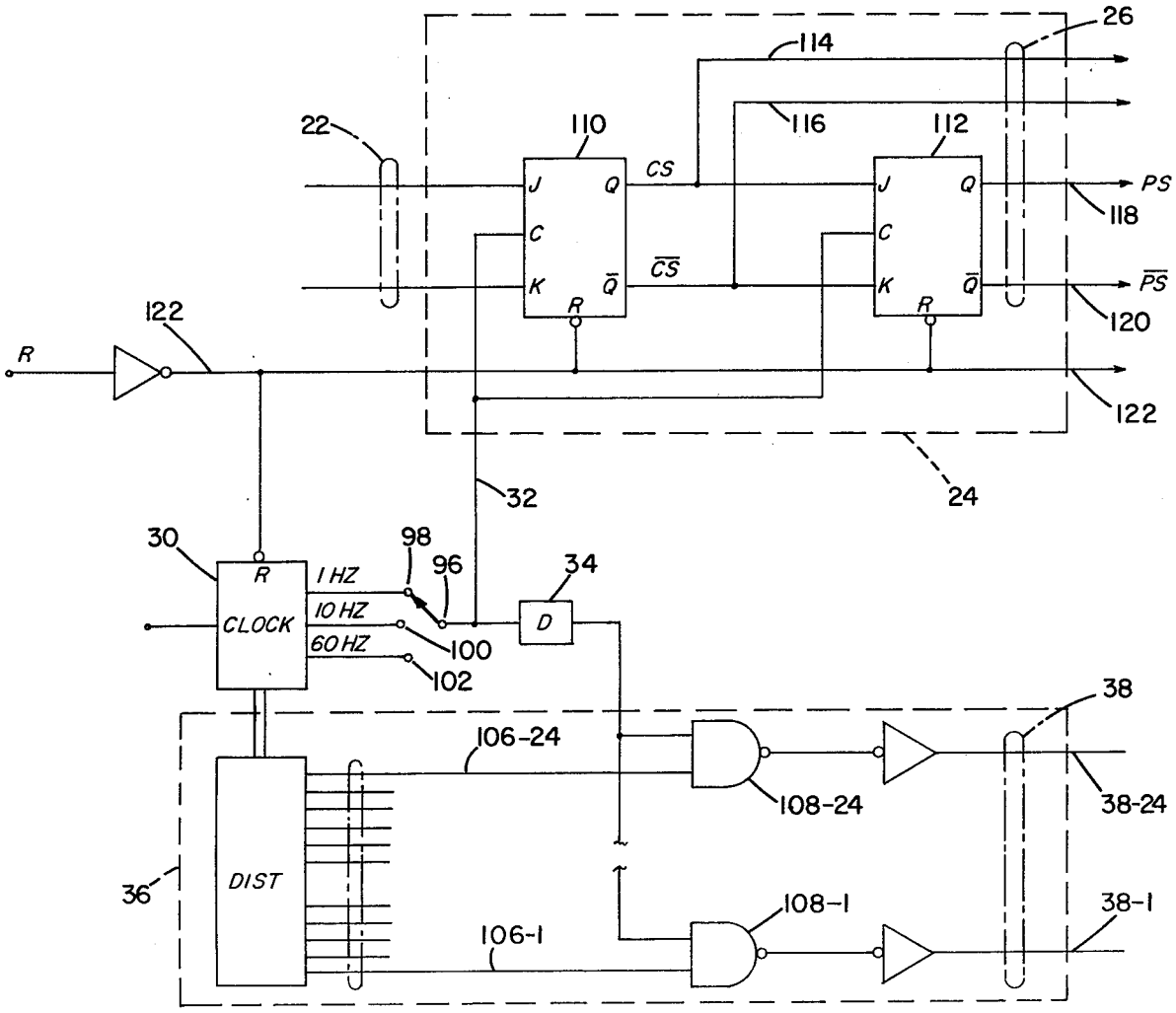
FIG. 3 is a logic diagram of clock and status register components of the analyzer shown in FIG. 1.

Details of a status register 24, clock module 30 and distributor 36 are shown in FIG. 3. Status register 24 is a two stage register that receives inputs from ILC circuit 20 over lines 22 and provides outputs over cable 26 to its data interpreter module 28. Clock module 30 provides basic timing for the analyzer, and when switch 96 is connected to terminal 98, as indicated in FIG. 3, clock 30 provides pulses at one hertz intervals on line 32. Switch 96 may be connected to clock output terminals 100, 102, to provide shorter interval analyzer timing sequences, for example for monitoring transient conditions of short duration. Coupled to clock module 30 is distributor 36 which has twenty-four output lines 106, each of which is energized for a one hour interval during which timing pulses are steered to a corresponding logic circuit of the data interpreter modules 28, distributor 36 thus providing a twenty-four hour cycle for the analyzer. The clock pulses on line 32 are passed through delay circuit 34 for steering by NAND circuits 108 on lines of cable 38. Status register 24 includes a current status stage 110 and a prior status stage 112, current status stage 110 providing current status signals on lines 114 and 116, and prior status stage 112 providing prior status signals on lines 118 and 120 of cable 26. A system reset signal on line 122 is coupled to the clock module 30, all the status registers 24, and all the data interpreter modules 28.

Figure 4:
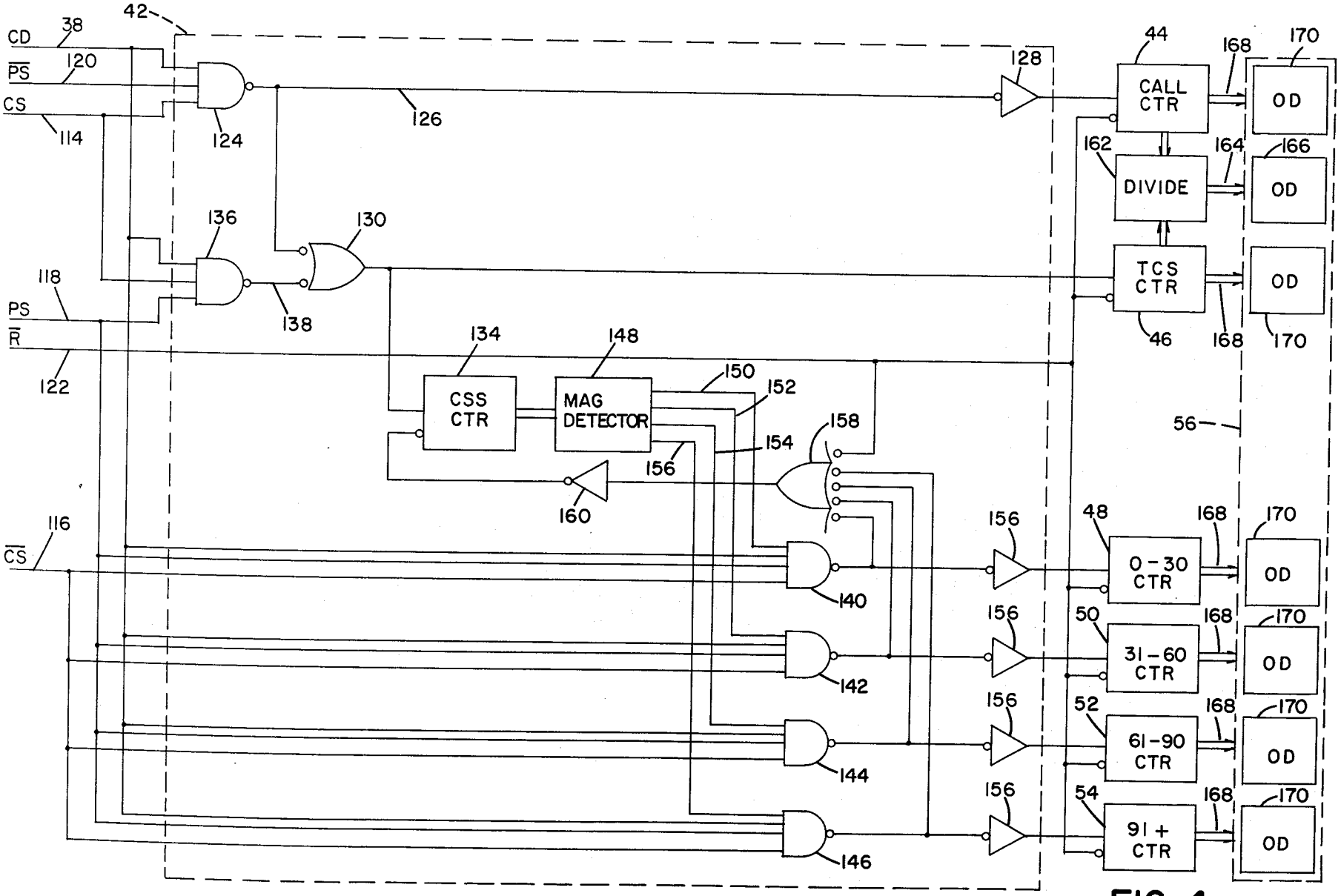
FIG. 4 is a logic clock diagram of a data interpreter module embodied in the analyzer shown in FIG. 1.

Details of a logic channel 42 and associated accumulator devices of a data interpreter module 28 may be seen with reference to FIG. 4. Each logic channel receives a delayed clock pulse every second on its input line 38 during the one hour interval that that logic channel is active, and status signals on lines 114–120 from its status register 24. The logic circuitry 42 includes NAND circuit 124 that produces an output in response to the delayed clock pulse on line 38 whenever its status register provides a CS signal on line 114 and a $\overline{PS}$signal on line 120 (thus NAND circuit 124 is conditioned whenever current status stage 110 is set and prior status stage 112 is cleared—indicating that its monitored call button 12 has just become active). The output of NAND circuit 124 on line 126 is applied through inverter 128 to increment Call Counter 44, and also through NOR circuit 130 to increment Total Call Second Counter 46 and Current Call Second Counter 134. NAND circuit 136 has inputs from the CS line 114 and PS line 118 of its status register (and thus NOR circuit 130 is conditioned whenever current status stage 110 is set—indicating that its monitored call button 12 is active). In response to the delayed clock pulse on line 38, conditioned NAND circuit 136 has an output on line 138 which produces an output from NOR circuit 130 to increment Total Call Second Counter 46 and Current Call Second Counter 134. Thus, Call Counter 44 is incremented each time that its monitored hall button 12 becomes active; and Total Call Second Counter 46 accumulates the total number of seconds that its monitored hall button is active.

The status register condition indicating that the monitored hall button 12 has become inactive (call cancelled) is signaled by status register signals on lines 116 ($\overline{CS}$) and 118 (PS), that combination of signals providing conditioning inputs to NAND circuits 140–146. Each of those NAND circuits has a third input from magnitude detector 148 that senses the accumulated count in Current Call Second Counter 134. Magnitude detector 148 has an output on line 150 when the monitored hall button has been active for up to thirty seconds; an output on line 152 when the monitored hall button has been active from thirty-one to sixty seconds; an output on line 154 when the monitored hall button has been active for sixty-one to ninety seconds; and an output on line 156 when the monitored hall button has been active for more than ninety seconds. When status register 24 signals a call cancellation (line 116-$\overline{CS}$), the single then conditioned NAND circuit 140–146, in response to a delayed clock pulse on line 38, has an output that is applied through its inverter 156 to increment its associated accumulator counter 48–54; and that output is also fed back through NOR circuit 158 and inverter 160 to reset CCS Counter 134. Thus, after each call has been cancelled, the time duration of that call is stored in a corresponding one of counters 48–54 and the logic circuitry is reset to await the next activation of the monitored hall button. All the counter accumulators are reset at the beginning of each monitoring interval by the system reset signal on line 122.

In summary, the count in accumulator 44 indicates the number of calls activated during the monitored time interval (one hour in this embodiment), the count in accumulator 46 indicates the total waiting time in seconds for the monitored call hall button 12 during their time interval; and the counts in accumulators 48–54 indicate the distribution of call durations in thirty second intervals. Connected between accumulators 44 and 46 is a divide circuit 162 whose output on lines 164 provides an average waiting time signal for the monitored hall button during the one hour interval. Contents of the accumulators are read out over lines 168 to appropriate output devices 170 for display or further processing as desired.

Similarly, a corresponding accumulator circuit in the logic of DIM 28C stores the time duration that its monitored car is in service.

Traffic or other system analyzers in accordance with the invention may be implemented in a variety of configurations. In a particular embodiment, the traffic analyzer is implemented in a system which combines the hardware of the monitored elevator system components with input level converter circuits 20 and a TRS 80 computer under the control of the computer program. The accumulated data at output devices 56, 58 is processed with a TRS computer system under the control of the computer program to produce a printed elevator traffic study report, portions of an illustrative resulting report being shown in FIGS. 5–9.

With reference to those Figures, the analyzed elevator system has four cars (line 172); and fourteen stops or landings (line 174). A separate page of the report provides analysis data for each of the twenty-six monitored hall buttons 12: the report page of FIG. 5 representing the analysis of the lobby UP call button as indicated at 176; the report of FIG. 6 summarizing the elevator analysis for the DOWN hall button at the top landing (as indicated at line 178); FIG. 7 being a composite summary (as provided by a totalizer 58, for example) of the activities of all the UP buttons of the analyzed elevator system; the FIG. 8 page being a composite summary of the activities of all the hall buttons of the analyzed system; and the FIG. 9 page of the report summarizing the number of cars in service during each of the hourly intervals of the twenty-four hour period during which the elevator system was monitored.

In the tabular listings of FIGS. 5–8, hourly intervals are listed under the "TIME SLOT" heading 180 (outputs of distributor 36). In the tabular listings of FIGS. 5–8, the number of calls during each hourly interval is listed under "# CALLS" heading 182 (accumulator 44); the total number of call seconds during that hourly interval is listed under the "TOT C/S" heading 184 (accumulator 46); the number of calls answered in thirty seconds or less is listed under the "0–30S" heading 186 (accumulator 48); the number of calls answered in thirty-one–sixty seconds is listed under the "31–60S" heading 188 (accumulator 50); the number of calls answered in sixty-one–ninety seconds is listed under the "61–90S" heading 190 (accumulator 52); the number of calls answered in over ninety seconds is listed under the "90+S" heading 192 (accumulator 54); and the average waiting time for the calls during each hourly interval is listed under the "AVG W/T" heading 194 (divider 162). In addition, the report lists totals for each of the monitored hall buttons as indicated in FIGS. 5 and 6, as well as composite totals for the UP buttons (FIG. 7), similar composite totals for the DOWN buttons, composite totals for the system as a whole (FIG. 8), and the number of cars in service during each hourly interval (FIG. 9).

With reference to FIG. 5, the report indicates that during the time period from 11:30 AM to 12:30 PM, thirty-one calls were activated at the lobby UP button with twenty-five of those calls being answered by the elevator system in thirty seconds or less, five of those calls being answered in thirty-one to sixty seconds and one of those calls being answered in sixty-one to ninety seconds, with an average waiting time of 18.65 seconds during that hourly interval. Throughout the twenty-four hour period during which the elevator system was monitored, the average waiting for lobby UP calls was 10.18 seconds. With reference to FIG. 6, during the same hourly interval, there were fourteen DOWN calls from the top floor, six of those calls being answered in thirty seconds or less, five of those calls being answered in thirty-one to sixty seconds, two of those calls being answered in sixty-one to ninety seconds, and one of those calls being answered in over ninety seconds. The average waiting time during that hourly interval was 38.29 seconds and the average over the entire twenty-four hour period was 28.48 seconds. The composite UP call summary of FIG. 7 indicates that during that same hour interval there were sixty-eight UP calls for the entire system with an average waiting time of 27.93 seconds per call; and the composite summary of all calls (FIG. 8) indicates that during that same hour interval there were a total of 231 calls with an average waiting time of 33.44 seconds per call but that the waiting time for each of thirteen calls exceeded ninety seconds (column 192). The tabular summary of FIG. 9 (available cars—heading 200) generated by four 18C channels (one for each car) indicates that three of the four cars were in service throughout the twenty-four hour monitoring interval with the exception of a brief interval during the 11:30 AM to 12:30 PM hour.

This traffic analyzer system is designed to interface with a wide range of signal devices of various types of apparatus and/or process control systems, including elevator systems and energy management systems. The hard copy output in the form illustrated in FIGS. 5–9 provides useful diagnostic information on the elevator system in a form that is easy to read and to analyze. Both the form of output data and the monitored elevator conditions and components may be varied as desired for particular applications. In a "trouble shooting" embodiment, for example, logic in data interpretor modules 28 (in software, hardware or mixed hardware-software form) may logically combine several different monitored functions of the system to be analyzed for display in the control room so that causes of system defaults may be quickly and accurately pinpointed.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. For use with a transportation system or the like having a plurality of interrelated system components, improved analyzer apparatus for evaluating the performance of said system comprising a plurality of monitoring channels, one for each said system component to be monitored, each said monitoring channel including interface circuitry for connection to a system component and arranged to provide an output electrical signal indicative of the current status of the system component monitored by the interface circuitry, logic responsive to a change in the status of the output signal provided by said interface circuitry.

signal generator means for repetitively generating time interval signals at periodic time intervals, a plurality of event accumulator devices coupled to said logic, means responsive to said time interval signals for causing said accumulator devices to accumulate event duration counts as a function of the current status signals provided by said interface circuitry, and output means for transferring the contents of said accumulator devices to a utilization device.

2. The analyzer apparatus of claim 1 wherein said system is a transportation system that has a plurality of elevator cars serving a plurality of common landings in a building in which said elevator cars are operating.

3. The analyzer apparatus of claim 2 wherein said interface circuitry comprises means for producing first signals representing the demand for an elevator car at each floor at selected time intervals.

4. The analyzer apparatus of claim 1 wherein a first event accumulator device counts the number of calls for a vehicle at each of a plurality of stations, and a second accumulator device counts the accumulated time that calls at such stations remain unanswered.

5. The analyzer apparatus of claim 1 wherein each said monitoring channel includes status register means for concurrently indicating the status of the monitored system component at at least two different times.

6. The analyzer apparatus of claim 1 wherein said accumulator devices include a first accumulator device for recording the number of calls for elevators at each of a plurality of floors and a second accumulator device for recording the accumulated time that calls for each said floor remain unanswered.

7. The analyzer apparatus of claim 1 wherein said utilization device provides a hard copy print out that includes summaries of monitored system component activity over a multiple hour monitoring interval with a separate summary for each monitored system component.

8. For use with a transportation system or the like having a plurality of interrelates system components, improved analzyer apparatus for evaluating the performance of said system comprising interface circuitry for connection to a system component and arranged to provide an output electrical signal indicative of the current status of the system component monitored by the interface circuitry, said interface circuitry comprising an input circuit for receiving a status signal from its monitored system component, threshold circuitry coupled to said input circuit for generating a trigger signal when the status signal from its input circuit exceeds its threshold, output circuitry for transferring signals to said logic, and isolator circuitry coupled between said threshold circuitry and said output circuitry and responsive to said trigger signal for causing said output circuitry to provide said output electrical signal, logic responsive to a change in the status of the output signal provided by said interface circuitry, signal generator means for repetitively generating time interval signals at periodic time intervals, a plurality of event accumulator devices coupled to said logic, means responsive to said time interval signals for causing said accumulator devices to accumulate event duration counts as a function of the current status signals provided by said interface circuitry, and output means for transferring the contents of said accumulator devices to a utilization device.

9. The analyzer apparatus of claim 5 and further including means to vary the threshold of said threshold circuitry.

10. The analyzer apparatus of either claim 5 or 6 wherein said input circuitry includes a voltage divider network arranged to apply a fraction of the voltage of said status signal to said threshold circuitry.

11. The analyzer apparatus of claim 5 wherein said inut circuitry includes as asymmetrically conductive device connected in circuit arrangement such that said interface circuitry processes both AC and DC status signals.

12. The analyzer apparatus of claim 5 wherein said isolator circuitry includes a photo isolator device.

13. For use with a transportation system or the like having a plurality of interrelated system components, improved analyzer apparatus for evaluating the performance of said system comprising a plurality of monitoring channels, one for each said system component to be monitored, each said monitoring channel including interface circuitry for connection to a system component to be monitored by that monitoring channel, each said interface circuitry comprising an input circuit for receiving a status signal from its monitored system component, threshold circuitry coupled to said input circuit for generating a trigger signal when the status signal from its input circuit exceeds its threshold, output circuitry for transferring signals, and isolator circuitry coupled between said threshold circuitry and said output circuitry and responsive to said trigger signal for causing said output circuitry to provide said output electrical signal, status register means coupled to said interface circuitry for concurrently indicating the status of the monitored system component at at least two different times on the basis of output signals from the monitored system component provided by said coupled interface circuitry, logic responsive to a change in the status of the output signal provided by said interface circuitry, signal generator means for repetitively generating time interval signals at periodic time intervals, said signal generator means including means for varying the time interval between said repetitive time interval signals, a plurality of event accumulator devices coupled to said logic, means responsive to said time interval signals for causing said accumulator devices to accumulate event duration counts as a function of the current status signals provided by said interface circuitry, and output means for transferring the contents of said accumulator devices to a utilization device, said utilization device providing a hard copy print out that includes summaries of monitored system component activity over a multiple hour monitoring interval with a separate summary for each monitored system component.

14. The analyzer apparatus of claim 13 wherein said system is a transportation system that has a plurality of elevator cars serving a plurality of common landings in a building in which said elevator cars are operating.

* * * * *